US005632329A

United States Patent [19]

Fay

[11] Patent Number: 5,632,329

[45] Date of Patent: May 27, 1997

[54] AIR COOLED CONDENSER

[75] Inventor: Herman P. R. Fay, Solana Beach, Calif.

[73] Assignee: GEA Power Cooling Systems, Inc., San Diego, Calif.

[21] Appl. No.: 555,477

[22] Filed: Nov. 8, 1995

[30] Foreign Application Priority Data

Nov. 8, 1995 [DE] Germany ..... 44 39 801.8

[51] Int. Cl.[6] ..... F28B 7/00; F28B 1/06

[52] U.S. Cl. ..... 165/113; 165/174; 165/146; 165/DIG. 193; 165/DIG. 222

[58] Field of Search ..... 165/110, 111, 165/112, 113, 146, 174, DIG. 193, DIG. 222

[56] References Cited

U.S. PATENT DOCUMENTS

| | | | |
|---|---|---|---|
| 3,073,575 | 1/1963 | Schulenberg | 165/174 X |
| 3,807,494 | 4/1974 | Ris | 165/110 |
| 4,190,102 | 2/1980 | Gerz | 165/113 |
| 4,330,034 | 5/1982 | Lang et al. | 165/113 |

FOREIGN PATENT DOCUMENTS

| | | | |
|---|---|---|---|
| 1079141 | 11/1954 | France | 165/174 |
| 1044125 | 2/1956 | Germany . | |
| 1873644 | 11/1961 | Germany . | |
| 1188629 | 3/1962 | Germany . | |

*Primary Examiner*—Allen J. Flanigan
*Attorney, Agent, or Firm*—Friedrich Kueffner

[57] ABSTRACT

A method for uniformly distributing the vapor conducted from a parallel flow condenser section of an air cooled condenser into the dephlegmator cubes of a subsequently arranged countercurrent condenser includes throttling gaseous fluids present at the ends of the dephlegmator tubes on the collector side when the gaseous fluids are withdrawn from the dephlegmator tubes. In the air cooled condenser for carrying out the method, at least the predominant majority of the dephlegmator tubes has resistance elements at or near where they connect to the gas collector.

11 Claims, 4 Drawing Sheets

AIR COOLED CONDENSER

BACKGROUND OF THE INVENTION

1. Field of the Invention

The present invention relates to a method for uniformly distributing the vapors leaving the parallel flow condensing section of an air cooled condenser into the dephlegmator tubes of a subsequently arranged countercurrent condensing section. The present invention also relates to an air cooled condenser for carrying out the method.

2. Description of the Related Prior Art

The use of air for the condensation of turbine vapor has long been known in the art. In the case of direct air condensation, the turbine vapor is condensed in fin tube elements arranged in parallel followed by the condensate being returned to the feed water cycle. The interior of the fin tube elements is under negative pressure, and entrained gases which cannot be condensed are withdrawn. The cooling air flow is generally produced by means of fans or, less frequently, by natural draft.

The air cooled condensers are arranged in modular fashion with the fin tube elements arranged vertically, horizontally or in an inclined A-like or V-like configuration, The roof-like or A-like configuration is widely used. In that case, the fin tube elements form two legs of a triangle and the fans form the third leg at the base of the triangle.

A major problem in air cooled condensers is the fact that freezing of the fin tube elements must be prevented during the winter months, particularly during operation with partial load, and the danger of freezing must be reliably eliminated with the use of apparatus which is as simple as possible and inexpensive.

Two configurations of air cooled condensers are common. They are the parallel flow condenser configuration and the countercurrent condenser configuration, also referred to as a dephlegmator.

In the case of the parallel flow condenser, the vapor flows downwardly in fin tubes fed from an upper distribution duct. The pressure drop in the fin tubes causes a temperature drop of the saturated vapor.

This temperature reduction essentially results in a drop of the operative temperature difference between the vapor and the cooling air, so that the efficiency of heat removal of the condenser is reduced.

Another more serious consequence is the fact that vapor in the fin tubes is completely condensed before it reaches the tube ends. This may occur in the case of low air temperatures or when operating under partial load. In that case, the condensate subcools very quickly and gases which cannot be condensed collect in the remaining tube sections in which no vapor is present. This leads to an increase of the oxygen absorption of the condensate which, in turn, may lead to corrosion problems. Moreover, subcooling of the condensate may result in freezing of the condensate when the air temperature is below 0° C., so that there is the danger that the cooling tubes are damaged or that they burst.

DE-AS 10 44 125 already discloses a proposal which has the purpose of preventing the freezing of the condensate in parallel air cooled condensers. In that case, the heat exchanger surfaces of the fin tubes are adjusted to the available temperature drop between the vapor entry temperature and the cooling air temperature in such a way that the condensation is concluded as uniformly as possible in all tube rows at a small distance from the ends of the tube rows where they connect to the condensate collection manifold. In order to achieve this vapor distribution, devices for throttling the vapor intake in the form of nozzles or shields are provided at the inlet side of the fin tubes.

It is a disadvantage that these shields are arranged at the inlet side because the entire vapor to be condensed in the condenser must flow through these shields and is distributed with a pressure loss into the fin tubes which are arranged one behind the other on the air side.

In addition, the disadvantages resulting from subcooling of the condensate can be prevented by using the above-mentioned countercurrent condenser configuration.

In that type of operation, the vapor is introduced from below into the fin tubes and is conducted in a countercurrent flow against the condensate which is draining off. Since the vapor continuously transfers heat to the condensate draining in the opposite direction, there is the advantage that subcooling of the condensate cannot occur when the apparatus is correctly dimensioned.

The countercurrent condenser configuration has the disadvantage of operating at a reduced heat transfer coefficient. Moreover, the possible condensation rate of a countercurrent condenser can be reduced if slug flow conditions exist which produce a holdup of the condensate in the fin tubes. Slug flow conditions are that state of operation in which the vapor introduced from below into the dephlegmator tubes and flowing upwardly can no longer flow against the mass of the downwardly flowing condensate. This causes a condensation holdup in the fin tubes.

A solution which has proved successful in practice is the combination of a parallel flow condenser and a countercurrent condenser, as disclosed, for example, in DE-PS 11 88 629.

In that case, fin tube elements operating as dephlegmators are arranged downstream of the fin tube elements operating as parallel flow condensers. The fin tube elements operating as dephlegmators are simultaneously arranged in groups in cooling sectors in such a way that, when operating under partial load and at external air temperatures below the freezing point during the winter months, at least a portion of the element groups operating as parallel flow condensers can be switched off on the vapor side as well as on the air side, so that the vapor is condensed predominantly in the element groups operating as dephlegmators. While the countercurrent condensers have a poorer efficiency as compared to the parallel flow condensers, they have the advantage that they do not freeze even when operating under partial load because of the continuous contact of the downwardly flowing condensate with the upwardly flowing vapor.

The so called condensation end of the vapor is then located in the countercurrent condenser, so that subcooling of the condensate is generally avoided. The system is regulated by switching off individual cooling sectors or by changing the cooling air flow.

In order to achieve a uniform distribution of the vapor flow introduced into the vapor distribution chamber of a countercurrent condenser with a relatively low flow speed, it is additionally known from DE-GM 18 73 644 to provide an intermediate sheet with openings in the vapor distribution chamber. The entire cross sectional area of the openings is smaller than the total cross sectional area of the condenser tubes.

This solution also has the purpose of regulating and uniformly distributing the vapor entering the individual condenser tubes.

The combined arrangement of fin tube elements as condensers and dephlegmators has proved successful in operation. However, in order to be able to handle very large load variations, particularly low vapor quantities during the winter months, without the danger of subcooling or freezing, it is also necessary in this arrangement to provide additional means for regulating and controlling the flow and quantity of the cooling air and the exhaust vapor.

It must be taken into consideration in this connection that, due to the parallel arrangement of all fin tube elements on the vapor side as well as on the condensate side, and in the case of admitting varying quantities of cooling air to the various groups, the pressure loss of the vapor flow is equal in all fin tube elements. This has the consequence that more vapor flows through the less strongly cooled group than could be condensed in this group, while simultaneously less vapor flows through the more strongly cooled groups than could be condensed in those groups. While the effect mentioned first has the disadvantage that excess vapor is withdrawn through the exhaust line to the vacuum system and, thus, the vacuum is negatively affected, the effect mentioned last has the disadvantage that the vapor is not admitted fully over the entire length of the fin tube elements and, consequently, there is still the danger of freezing in the case of very low ambient air temperatures.

In addition, particularly in the case of high loads, a condensate holdup may occur in the cooling tubes of the counterparallel flow condenser, with the result that vapor penetrates into the upper non-condensible gas collector and then enters the fin tubes from above producing so called cold pockets in the fin tubes in which inert gases collect, so that the efficiency of the countercurrent condenser is reduced.

SUMMARY OF THE INVENTION

Therefore, it is the primary object of the present invention to provide a method of operating an air cooled condenser with at least one parallel flow condenser and a countercurrent condenser arranged downstream of the parallel flow condenser, and to improve such an air cooled cooler in a simple manner in such a way that, while achieving a high total efficiency, an adaptation to strongly varying exhaust vapor quantities and large temperature differences of the cooling air is possible, wherein especially the inflow of vapor into the vacuum system (non-condensibles ejection system) is reduced and a uniform and complete flow into the dephlegmator tubes is achieved.

In accordance with the present invention, any gaseous fluids present at the ends of the dephlegmator tubes on the collector side are throttled when they are withdrawn from the dephlegmator tubes.

In the air cooled condenser according to the present invention, at least the predominant majority of the dephlegmator tubes has resistance elements in the areas of their ends at the gas collector side.

Accordingly, it is the essence of the present invention to prevent large quantities of gaseous fluids from entering the gas collection chamber in unimpeded fashion from any fin tube. Since the flow is throttled, the fluid is uniformly distributed over all dephlegmator tubes, so that the entire heat transfer surface area is utilized for condensation. Cold pockets or dead zones in which exhaust vapor or condensate could be present are avoided.

The provision of resistance elements at the gas collector ends of at least the predominant number of dephlegmator tubes presents an obstacle to the exhaust vapor, particularly when excess vapor is present. Consequently, the vapor entering the individual dephlegmator tubes from below is distributed uniformly.

The resistance elements may have different shapes and dimensions. For example, conically shaped or round bodies are conceivable, as well as cap-shaped or plug-shaped structures. However, the use of shields has been found practical. The dimensions of the apertures of the shields are always selected in such a way that their cross sectional areas are smaller than the inner cross sectional areas of the dephlegmator tubes.

In the case of perforated shields, the size and shape of apertures can vary. It is also conceivable that the individual resistance elements within a countercurrent condenser are constructed differently. It is basically also possible not to equip all fin tubes with resistance elements The resistance elements can be secured by welded connections, soldered connections or adhesive connections. However, other connections are also conceivable, for example, a connection by frictional engagement.

It is advantageous if the same resistance elements are arranged near the ends of all cooling tubes. The resistance elements then present an obstacle only to the remaining inert gas or the excess vapor. Consequently, the transverse distribution of the exhaust vapor in the condenser is rendered uniform not only in fin tube elements which are composed of only one row of tubes, but also in fin tube elements which have a plurality of tube rows.

However, the resistance elements have the uniformly distributing effect only when larger quantities of vapor or inert gas are conducted to the upper ends of the tubes of the countercurrent condenser. During normal operation, i.e., when the condensation is concluded at the upper ends of the tubes, the pressure conditions in the countercurrent condenser are not changed by the resistance elements because of the small quantity of inert gas to be withdrawn.

The resistance elements have the purpose of preventing excess quantities of vapor from being conducted from the countercurrent condenser into the air withdrawal system which would cause overloading of the ejection equipment.

Accordingly, the resistance elements act only as obstacles to the flow when the exhaust vapor reaches the upper ends of the tubes. Consequently, it is not the purpose of the resistance elements to regulate the entry of the vapor into the individual cooling tubes, but to ensure that the withdrawal is carried out uniformly.

In addition, the resistance elements are capable of preventing return flow of the vapor from the upper collection chamber of the countercurrent condenser back into the cooling tubes from above.

One of the significant advantages of the condenser according to the present invention is its behavior during regulation, particularly in the case of partial load.

This is because, in the case of partial load, it is not necessary to lock and render inoperative entire groups of parallel flow condensers and countercurrent condensers by means of appropriate features; rather, it is only necessary to switch off the cooling air fans of individual condenser groups. This means that a switched-off condenser group remains filled with vapor. Only a slight cooling takes place in this condenser group because the fans are switched off. In this situation, the resistance elements prevent an overload of the ejection equipment which continues to withdraw inert gas from the remaining condenser groups which operate under load, while vapor is withdrawn from the condenser groups which have been switched off. As a result, the vacuum in the air cooled condenser continues to be maintained.

In the case of a change of the load and a consequently required change of the condenser output, this change of the condenser output can be carried out by switching fans on or off or by regulating the rate of rotation or the angle of the blades of the fans. Such a regulation can also be carried out in the case of a possible increase of the condenser pressure. In the case of a rise of the condenser pressure, more condenser groups can be operated or the output of the fans can be increased. On the other hand, when the condenser pressure drops, the output of the fans is lowered.

In accordance with another advantageous embodiment of the present invention, the resistance elements are not arranged immediately at the ends of the cooling tubes, but rather a short distance from the collector ends of the dephlegmator tubes. This creates a separate fin tube section downstream of the resistance element. A small amount of fluid continuously passes through the resistance element entering the separate fin tube section where it is cooled to temperature levels closely approaching the temperature of the air entering this section. The fluids passing through the resistance element can be water vapor saturated non-condensible gases, or a combination of the above, plus pure steam. If only saturated non-condensible gases are flowing through the resistance element, the vapor fraction of these gases is partially condensed, reducing the load on the ejection equipment. If a combination of non-condensible gases plus pure steam is flowing through the resistance element, then the steam is condense and the vapor fraction in the non-condensibles is partially condensed, once again reducing the load on the ejection equipment. Therefore, the cooling of the fluids in the separate fin tube section downstream of the resistance element has the effect of greatly increasing the efficiency of non-condensible gas withdrawal.

In accordance with a further development of the present invention, the resistance elements form at least part of a sheet arranged above the ends of the dephlegmator tubes. It is also conceivable to arrange several sheets, wherein these sheets may also be displacable relative to each other. In this manner, the cross sectional size of the openings is adjustable.

It is also possible to construct the resistance elements in the form of nets. The resistance elements can then be part of a net arranged in the area of the ends of the dephlegmator tubes or individual net or screen inserts may be arranged at the tube ends. Because of the adhesion forces acting between the webs of the net and 6he exhaust gas, a self-regulation of the shield function and of the flow resistance is possible.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figures 1, 2:
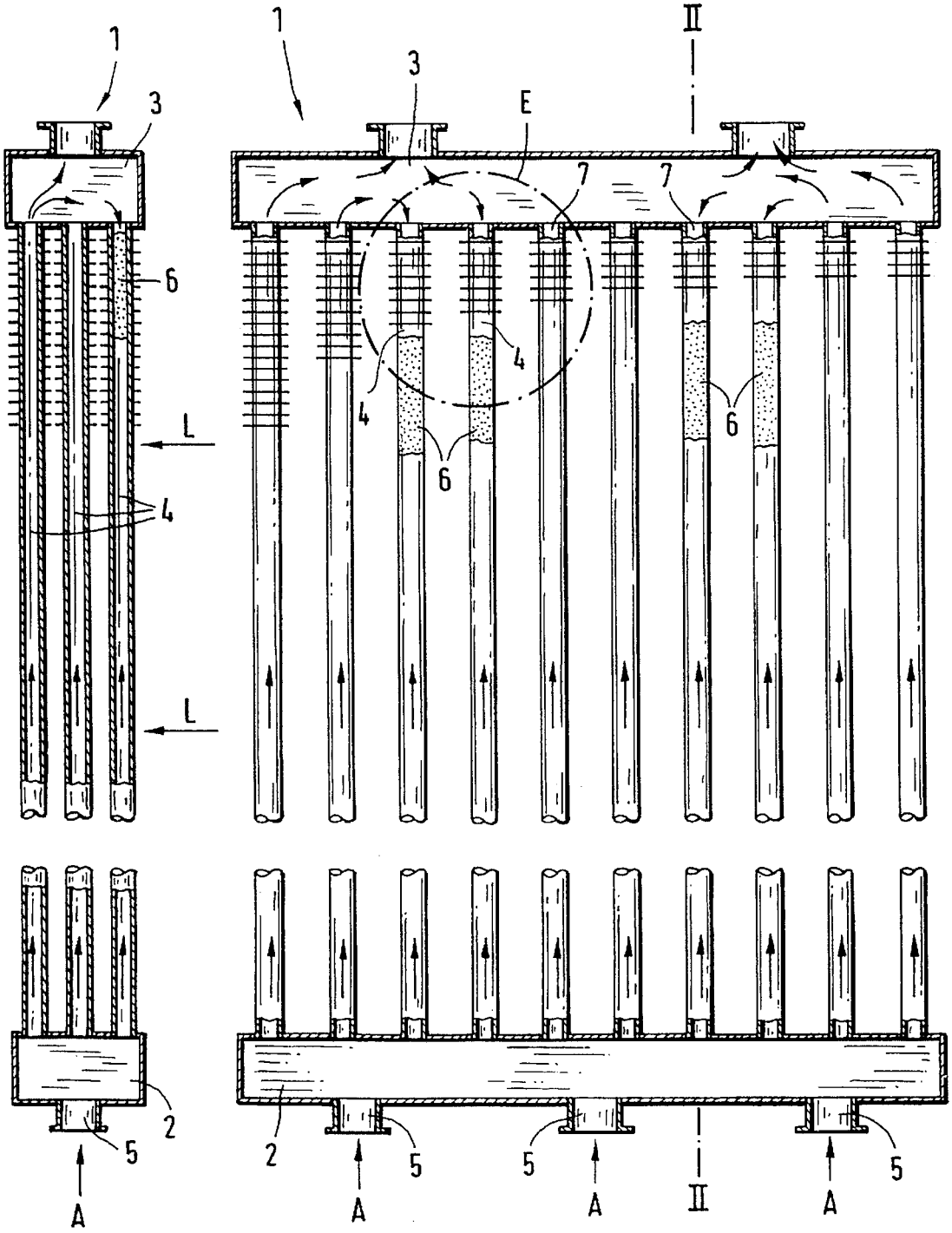
FIG. 1 is a schematic longitudinal sectional view of a row of cooling tubes of a countercurrent condenser.
FIG. 2 is a vertical transverse sectional view taken along sectional line II—II of FIG. 1.

FIGS. 1 and 2 of the drawing show a countercurrent condenser 1 with a lower vapor distribution chamber 2 and an upper gas collector 2. The steam distribution chamber 2 and the gas collector 3 are connected to each other through dephlegmator tubes 4.

The exhaust vapor A is conducted into the vapor distribution chamber 2 and is distributed over the individual dephlegmator tubes 4. Cooling air flows transversely against the dephlegmator tubes 4 in the direction denoted by L. The exhaust vapor A rises in the dephlegmator tubes 4 and condenses as a result of the continuous transfer of heat. The condensate then flows downwardly against the upwardly flowing exhaust vapor A.

The air collected in the gas collecting chamber is withdrawn by means of a vacuum system, not shown.

Because of the different cooling and flow conditions in the dephlegmator tubes 4, it is possible that exhaust vapor A and/or saturated inert gas can flow into the gas collection chamber 3, wherein the exhaust vapor A then partially flows from above into those dephlegmator tubes 4 to which less exhaust vapor has been admitted. Consequently, so called cold pockets 6 are formed in which inert gas is present, so that the efficiency of the countercurrent condenser is reduced.

Figure 1A:
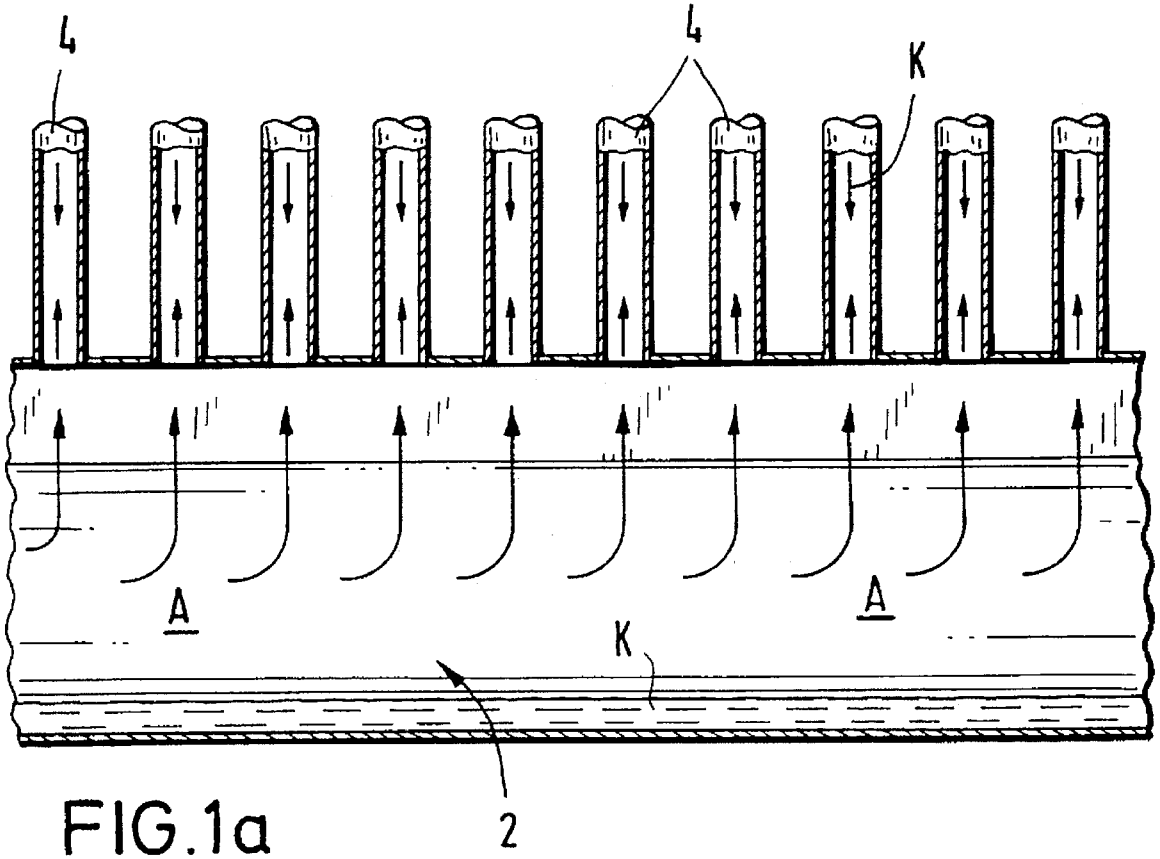
FIG. 1*a* is a vertical longitudinal sectional view of a detail of the area of a countercurrent condenser on the side of the steam distributor.
Figure 2A:
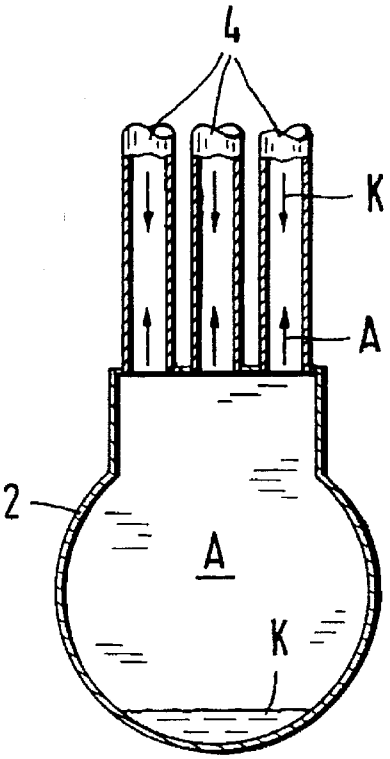
FIG. 2*a* is a side view of the area illustrated in FIG. 1*a*.

FIGS. 1*a* and 2*a* show the flow directions of the exhaust vapor A and the condensate K in the countercurrent condenser 1. The exhaust vapor A flows upwardly from the vapor distribution chamber 2 into the dephlegmator tubes 4. This causes the exhaust vapor A to be cooled and condensed. The condensate K produced in this manner then flows downwardly against the upwardly flowing exhaust vapor A and is collected at the bottom of the vapor distribution chamber 2.

Figure 3:
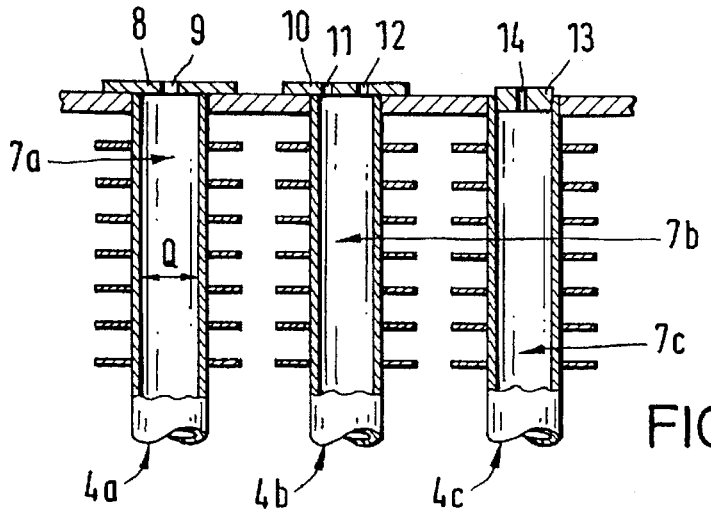
FIG. 3 is an illustration, on a larger scale, of the detail E of FIG. 1 shown with three different shields.

FIG. 3 of the drawing shows the ends 7*a* through 7*c* of three dephlegmator tubes 4*a* through 4*c* on the side of the gas collection chamber.

A resistance element in the form of a shield with an aperture 9 is arranged above the end 7*a* of the dephlegmator tube 4*a*. The aperture 9 has a significantly smaller diameter than the diameter Q of the dephlegmator tube 4*a*.

Another embodiment of a resistance element is illustrated in FIG. 3 in the form of a shield 10 at the end 7*b* of the dephlegmator tube 4*b*. In this case, the shield 10 has two apertures 11 and 12 which are located next to each other.

A resistance element in the form of a shield 13 is inserted into the end 7*c* of the dephlegmator tube 4*c*. The shield 13 again has only one aperture 14.

Figure 4:
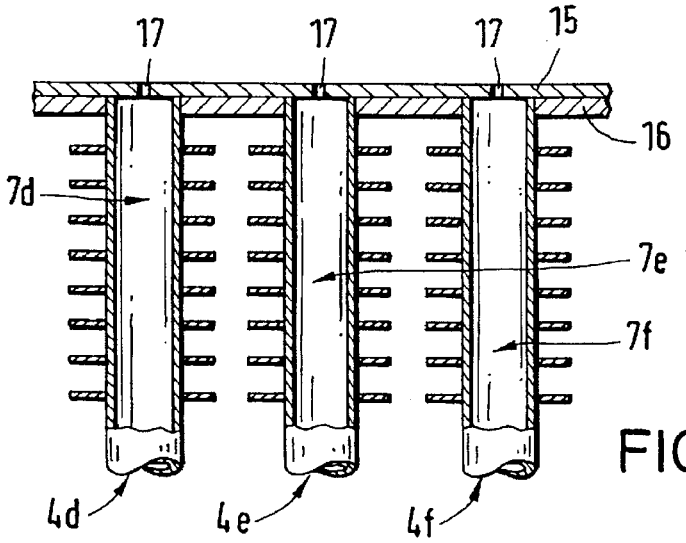
FIG. 4 is an illustration, on a larger scale of the detail E of FIG. 1 with the arrangement of a shield plate above the ends of the dephlegmator tubes.

FIG. 4 of the drawing shows a shield plate 15 which is placed directly onto a tubesheet 16. Above the ends 7*d* through 7*f* of the dephlegmator tubes 4*d* through 4*f*, resistance elements in form of apertures 17 are provided in the shield plate 15.

FIG. 5 of the drawing again shows the ends 7*g* through 7*i* of three dephlegmator tubes 4*g* through 4*i* having different resistance elements.

In the dephlegmator tube 4g, a shield 18 incorporating aperture 19 is mounted at a short distance away from its end. This produces a subcooling section behind the shield 18 which increases the effect of the air withdrawal.

The dephlegmator tube 4h has a resistance element 20 in the form of a plug-like insert 22 with an aperture 21.

In the dephlegmator tube 4i, the resistance element 23 has the form of a net insert 24. This net insert 24 may be arranged at the end of the dephlegmator tube 4i as shown in the drawing, or the net insert 24 may be inserted and arranged a distance away from the end, so that a subcooling stretch is also formed in this case.

Figure 6:
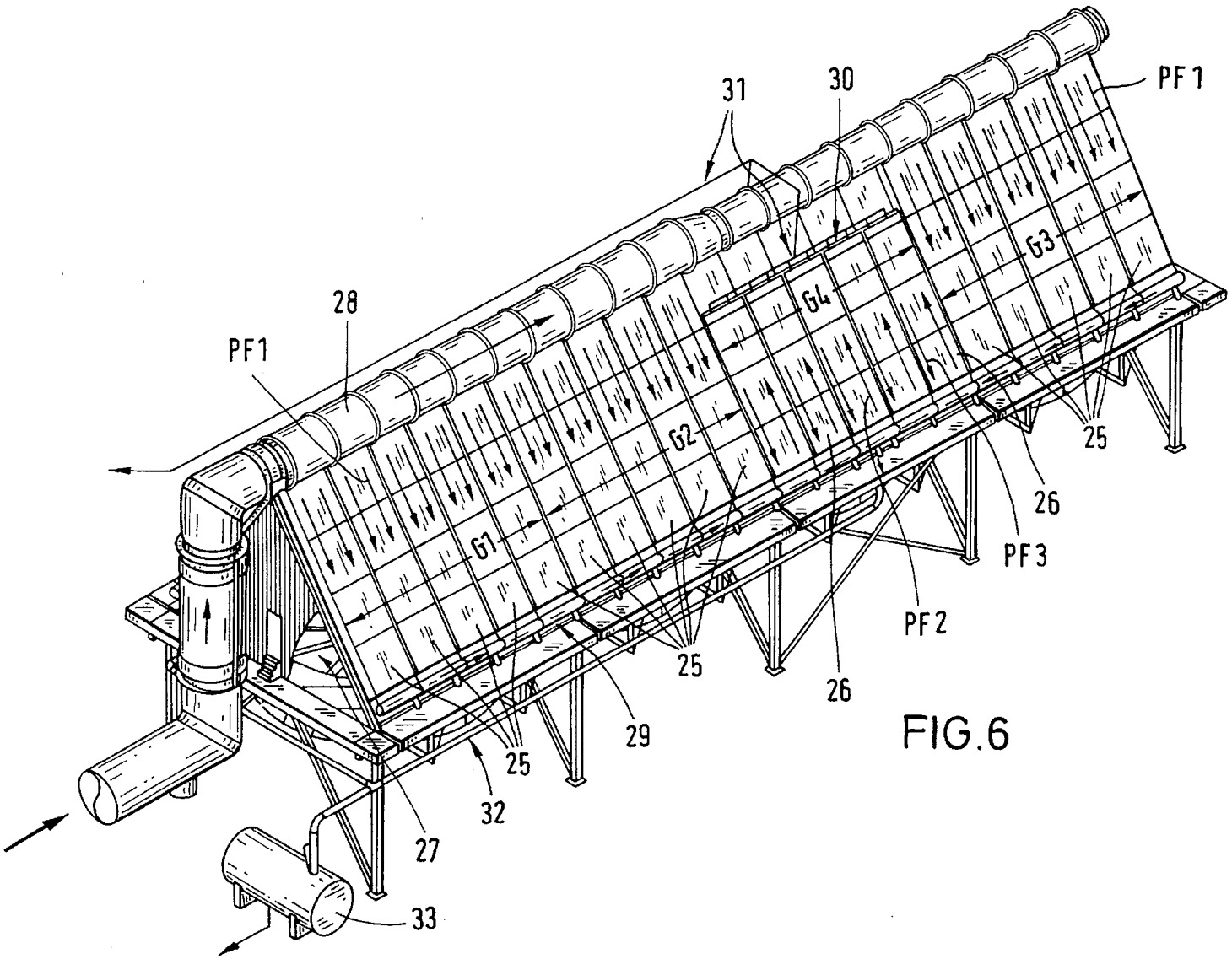
FIG. 6 is a perspective front view of portion of a dry cooling plant with a combination of parallel flow condensers and countercurrent condensers.

FIG. 6 is a perspective illustration of a branch of an air cooled condenser. A number of such branches are usually arranged next to one another, wherein exhaust vapor is admitted parallel to each of the branches. A typical branch is composed of three groups G1, G1 and G3 of fin tubes 25 which operate as parallel flow condensers and a group G4 with fin tubes 26 which operate as dephlegmators, i.e., countercurrent condensers. Fans 27 for producing the cooling air flow are arranged underneath the fin tubes 25, 26.

The steam exhausting from a turbine is transported through a distributing line 28 to the fin tubes 25 which operate as parallel flow condensers. In the fin tubes 25, the exhaust steam flows downwardly from the distributing line 28 in the direction of arrow PF1 and partially condenses. A condensate collecting line 29 is arranged at the lower end of the fin tubes 25. The exhaust vapor which has not yet been condensed also is conducted into the condensate collecting line 29 and is conducted through the condensate collecting line 29 to the fin tubes 26 which operate as dephlegmators and is conducted from below into the fin tubes in the direction of arrow PF2. The upwardly flowing exhaust vapor is conducted against condensate flowing downwardly in the direction of arrow PF3.

Figure 5:
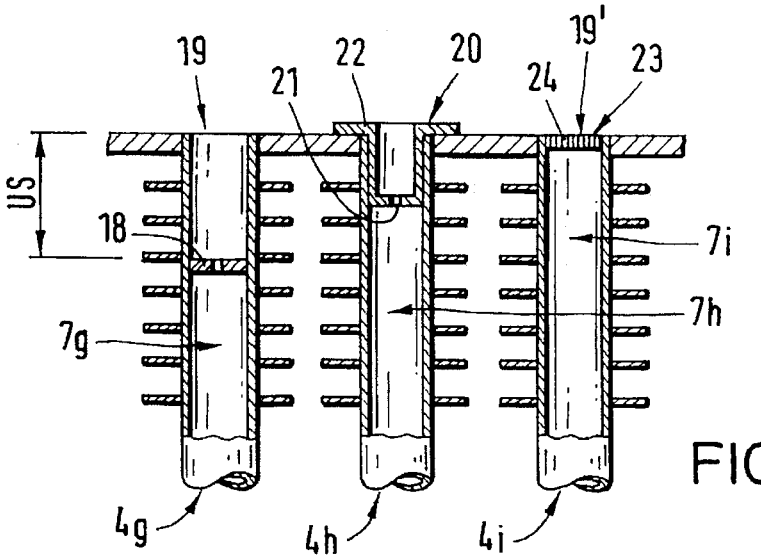
FIG. 5 is an illustration, on a larger scale, of the detail E of FIG. 1 with three additional possible configurations of the resistance elements.

A gas collector 30 is provided at the upper end of the fin tube elements 26. The resistance elements 8, 10, 13, 15, 18, 20, 23 described in connection with FIGS. 3, 4 and 5 are installed in the area of the ends of the tubes near gas collector 30.

The gases which cannot be condensed enter the gas collector 30 and are suctioned away through a pipe line 31 by a vacuum system.

The entire condensate produced in the fin tube elements 25 and 26 operating as parallel flow condensers and dephlegmators is collected in the condensate collecting line 29 and is conducted through a pipe line 32 to a condensate collecting tank 33. From the condensate collecting tank 33, the condensate is returned into the feed water cycle.

The resistance elements 8, 10, 13, 15, 18, 20, 23 at the ends 7a through 7i of the dephlegmator tubes 4a through 4i at the side of the gas collector have the purpose of preventing excess quantities of vapor from reaching the air withdrawal system. Consequently, the resistance elements 8, 10, 13, 15, 18, 20, 23 act as flow limiting means. However, these resistance elements become only effective when a certain minimum quantity of exhaust vapor A reaches the upper ends 7a through 7i of the dephlegmator tubes 4a through 4i. In that situation, the resistance elements 8, 10, 13, 15, 18, 20, 23 ensure a uniform distribution of the exhaust vapor A which enters the individual dephlegmator tubes 4a through 4i from below.

This uniform distribution positively influences the regulation behavior of the condenser, particularly when operating under partial load. It is now no longer necessary to switch off entire branches of parallel flow condensers and countercurrent condensers. Rather, it is sufficient to switch off or lower the output of the cooling air fans 27 of individual branches. While the tubes of these branches remain filled with vapor, a reduced heat transfer takes place. This prevents the danger of freezing and of overloading of the vacuum system. Consequently, the parallel flow condenser groups of the air cooled condenser can be regulated without requiring additional control and isolation features. A reduced condenser output takes place depending on the operational requirements. This makes possible a simple regulation and control which can be incorporated in existing plants.

While specific embodiments of the invention have been shown and described in detail to illustrate the inventive principles, it will be understood that the invention may be embodied otherwise without departing from such principles.

I claim:

1. A method for uniformly distributing vapor conducted from a parallel flow condenser of an air cooled condenser into dephlegmator tubes of a countercurrent condenser arranged downstream of the parallel flow condenser, wherein the dephlegmator tubes have ends at a collector side, the method comprising throttling gaseous fluids present at the ends of the dephlegmator tubes near the collector when the gaseous fluids are withdrawn from the dephlegmator tubes.

2. An air cooled direct condenser comprising at least one parallel flow condenser and at least one countercurrent condenser arranged downstream of the parallel flow condenser, the countercurrent condenser having a lower vapor distribution chamber, an upper gas collector and a plurality of dephlegmator tubes connecting the lower vapor distributing chamber and the upper gas collector, wherein the dephlegmator tubes have ends connecting to the gas collector, and wherein at least a predominant majority of the dephlegmator tubes have resistance elements for throttling flow of vapor from the dephlegmator tubes into the upper gas collector, the resistance elements being mounted at or near the ends of the dephlegmator tubes facing the upper gas collector.

3. The air cooled condenser according to claim 2, wherein the resistance elements partially close the ends of the dephlegmator tubes at the upper gas collector.

4. The air cooled condenser according to claim 2, wherein the resistance elements are mounted inside the dephlegmator tubes at a distance from the upper gas collector, the dephlegmator tubes comprising subcooling sections between the resistance elements and the ends facing the upper gas collector.

5. The air cooled condenser according to claim 2, wherein the resistance elements are shields.

6. The air cooled condenser according to claim 5, wherein each shield has at least one aperture, each dephlegmator tube having an inner cross sectional area, wherein each aperture has a cross sectional area smaller than the inner cross sectional area of the dephlegmator tube.

7. The air cooled condenser according to claim 5, wherein each shield has apertures having sizes, wherein the sizes of the apertures of each shield are different from each other.

8. The air cooled condenser according to claim 5, wherein each shield has apertures, each aperture having a size, further comprising means for adjusting the sizes of the apertures.

9. The air cooled condenser according to claim 5, wherein the shields are mounted so as to at least partially close the ends of the dephlegmator tubes.

10. The air cooled condenser according to claim 2, further comprising a sheet mounted above the ends of the dephlegmator tubes at the gas collector, the resistance elements being apertures in the sheet provided above the ends of the dephlegmator tubes.

11. The air cooled condenser according to claim 2, wherein each resistance element is a net-like member.

* * * * *

UNITED STATES PATENT AND TRADEMARK OFFICE

CERTIFICATE OF CORRECTION

PATENT NO. : 5,632,329

DATED : May 27, 1997

INVENTOR(S) :

Herman Peter Rolf Fay

It is certified that error appears in the above-indentified patent and that said Letters Patent is hereby corrected as shown below:

On the title page:

[30] Foreign Application Priority Data

Nov. 8, 1994 [DE] Germany.....44 39 801.8

Signed and Sealed this

Twenty-first Day of October 1997

*Attest:*

Bruce Lehman

BRUCE LEHMAN

*Attesting Officer*

*Commissioner of Patents and Trademarks*